US006392155B1

(12) United States Patent
Shimizu et al.

(10) Patent No.: US 6,392,155 B1
(45) **Date of Patent: *May 21, 2002**

(54) FLAT CABLE AND PROCESS FOR PRODUCING THE SAME

(75) Inventors: Yasutomi Shimizu; Osamu Mochizuki; Fumio Shimizu, all of Ibaraki (JP)

(73) Assignee: Hitachi Cable, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/354,365

(22) Filed: Jul. 14, 1999

(30) Foreign Application Priority Data

May 7, 1999 (JP) ..... 11-127204
May 7, 1999 (JP) ..... 11-127205

(51) Int. Cl.[7] ..... H01B 11/02
(52) U.S. Cl. ..... 174/117 F; 29/825
(58) Field of Search ..... 174/113 R, 117 F, 174/117 FF, 36, 110 R; 29/825

(56) References Cited

U.S. PATENT DOCUMENTS 3,836,415 A * 9/1974 Hilderbrandt ..... 156/296
4,218,581 A * 8/1980 Suzuki ..... 174/117 F
4,413,469 A * 11/1983 Paquin ..... 57/293
4,564,723 A * 1/1986 Lang ..... 174/36
4,767,891 A * 8/1988 Biegon et al. ..... 174/34
4,924,037 A * 5/1990 Ainsworth et al. ..... 174/117 F
4,978,813 A * 12/1990 Clayton et al. ..... 174/117 F
5,223,062 A * 6/1993 Tanihira et al. ..... 156/55
5,357,058 A * 10/1994 Tanihira et al. ..... 174/112
5,481,069 A * 1/1996 Anderson et al. ..... 174/117 F
5,900,588 A * 5/1999 Springer et al. ..... 174/117 F

FOREIGN PATENT DOCUMENTS

DE 32 05 038 A1 * 8/1983 ..... H01B/7/08

* cited by examiner

*Primary Examiner*—Dean A. Reichard
*Assistant Examiner*—William H. Mayo, III
(74) *Attorney, Agent, or Firm*—Scully, Scott, Murphy & Presser

(57) ABSTRACT

A flat cable having a linear portion in at least a part thereof. The linear portion has a plurality of insulated conductors juxtaposed to one another with adjacent insulated conductors being adhered to each other to provide an integral insulative layer, and a resin tape applied to the surface of the integral insulative layer so as to conform to the shape of the surface. In the production of this flat cable, a plurality of insulated conductors, together with a resin tape, are feed into a mold. In the mold, adjacent insulated conductors in their insulative layers are fused to each other to form an integral insulative layer. The resin tape is applied to the integral insulative layer so as to conform to the shape of the surface of the integral insulative layer.

8 Claims, 5 Drawing Sheets

FLAT CABLE AND PROCESS FOR PRODUCING THE SAME

FIELD OF THE INVENTION

The invention relates to a flat cable and a process for producing the same, and more particularly to a flat cable, which can eliminate the need to increase the width dimension without detriment to electric characteristics and further has a stable structure, and a process for producing the same.

BACKGROUND OF THE INVENTION

A flat cable generally comprises: linear portions each comprising a plurality of insulated conductors juxtaposed to one another, the insulated conductors each comprising a conductor covered with an insulative layer; and twisted pair portions provided alternately with the linear portions, the twisted pair portions each comprising a plurality of twisted pairs juxtaposed to each other or one another, the twisted pairs each being composed of two insulated conductors which extend from the linear portions and are twisted together.

In flat cables of this type, the construction of the linear portion is an important element. Improper construction of this portion, for example, adversely affects the connection of conductors of the insulated conductors in the linear portion to a connector, making it impossible for the flat cable to have contemplated functions.

In a first conventional flat cable, the linear portion has such a construction that a plurality of insulated conductors each comprising a conductor covered with an insulative layer are provided side by side while leaving a spacing between adjacent insulated conductors, and the plurality of insulated conductors are sandwiched between upper and lower resin tapes in such a manner that the upper and lower resin tapes are fused to each other in a portion between adjacent insulated conductors.

In a second conventional flat cable, the linear portion comprises: a plurality of insulated conductors with adjacent insulated conductors in their insulative layers being fused to each other to constitute an integral insulative layer having crest portions and root portions; and a resin tape which is provided on one surface of the integral insulative layer so that it is spottily adhered to the integral insulative layer in its crest portions.

Flat cables having the above constructions, wherein the linear portions have been flattened by the resin tape, have been extensively used for internal wiring in electronic equipment, such as personal computers.

The conventional flat cables having the above constructions, however, have the following drawbacks. In the linear portions of the first conventional flat cable, the resin tape is provided between adjacent insulated conductors. This results in increased width dimension of the flat cable. In the case of flat cables, in many cases, the width dimension is regulated. The construction of the first conventional flat cable in its linear portions makes it difficult to follow the regulation value. Reducing the diameter of the insulated conductors is considered effective for overcoming this difficulty. This, however, leads to deteriorated electric characteristics of the flat cable. Further, regarding the dimensional accuracy, in the linear portions of the first conventional flat cable, the accuracy of the pitch between insulated conductors is low due to the presence of the resin tape between adjacent insulated conductors. This is likely to cause a failure of fitting at the time of pressure contact connection.

On the other hand, according to the construction of the linear portions in the second flat cable, there is no need to widen the portion between adjacent insulated conductors, and the accuracy of pitch between insulated conductors is high. In the linear portions of the second conventional flat cable, however, since the resin tape is spottily adhered to the insulative layer, there is a fear of the resin tape being separated from the insulative layer. Further, this construction has an additional problem that, at the time of simultaneous connection of conductors of the insulated conductors to a connector, it is difficult to insert pins of the connector, leading to poor fitting between the cable and the connector.

Next, a general conventional production process of flat cables will be explained. A predetermined number of insulated conductor pairs are first provided. Each of the insulated conductor pair is composed of two insulated conductors each comprising a conductor covered with an insulative layer, and has linear portions and twisted pair portions provided alternately with the linear portions at predetermined spacing. In the linear portions, the two insulated conductors are juxtaposed to each other, while in the twisted pair portions, the two insulated conductors are twisted together. The predetermined number of insulated conductor pairs are placed side by side and, in this state, are fed from a bobbin (not shown) into a mold. The mold is split into two parts, openable upper mold and lower mold. The upper and lower molds have grooves the number of which is such as will be able to receive all the insulated conductors in the linear portions. In the grooves, the insulated conductors are placed in such a positional relationship that adjacent conductors come into contact with each other. In this state, upon application of heat from the mold, the adjacent insulated conductors in their insulative layers are fused to each other to form a belt comprising insulated conductors connected to one another, thereby providing a linear portion wherein the surface of the integrated insulative layer has crest portions and root portions as viewed in the cross section of the linear portion.

The fusion of the insulated conductors to one another is carried out on a batch basis rather than a continuous basis. After the formation of the linear portion, the mold is opened. In this state, the twisted portion is passed through the mold. A next linear portion is then fed into the mold, and fusion of the insulated conductors to one another is again carried out. The above procedure is then repeated.

After the insulated conductor pairs in their linear portion are integrated with one another in the mold, they emerge from the mold, are passed through a take-up unit, and, together with a resin tape, are fed into between heating rollers to fuse the resin tape to one surface thereof. Thus, a predetermined flat cable is obtained wherein, in the linear portions, the resin tape has been spottily adhered onto the integral insulative layer in its crest portions.

The flat cable, of which the flatness of the linear portions is kept by the resin tape, enables simultaneous connection of conductors in the linear portion to a connector and hence has been extensively used in various types of electronic equipment including personal computers, and a further increase in demand thereof is expected.

In the conventional process of a flat cable, the adhesion of the resin tape to the integral insulative layer is intermittent. That is, the resin tape is adhered to only the crest portions of the integral insulative layer. This leads to a fear of the resin tape being separated from the insulative layer. This further poses a problem that, at the time of simultaneous connection of conductors in the linear portion to a connector, the resin tape in its portion floating above the root portions of the integral insulative layer inhibits fitting between the linear portion and the connector. The above problems are attributable to fusion using heating rollers, and hence are unavoidable without the elimination of reliance of the fusion upon the heating rollers.

SUMMARY OF THE INVENTION

Accordingly, it is an object of the invention to provide a flat cable that can eliminate the need to increase the width dimension without detriment to electric characteristics, has high accuracy of pitch between insulated conductors, and has a stable structure having no fear of the resin tape being separated from the insulative layer.

It is another aspect of the invention to provide a process for producing a flat cable that enables the resin tape to be fused to the resin layer so as to conform to the shape of the surface of the insulative layer without spot fusion and, in addition, so as to prevent the inhibition of the resin tape against simultaneous connection of conductors in the linear portion of the flat cable to a connector.

According to the first feature of the invention, a flat cable comprises: a plurality of insulated conductors each comprising a conductor covered with an insulative layer, said plurality of insulated conductors being juxtaposed to one another with adjacent insulated conductors in their insulative layers being adhered to each other, to provide an integral insulative layer having crest portions and root portions as viewed in the cross section of the juxtaposed insulated conductors; and a resin tape applied to the surface of the integral insulative layer so as to conform to the shape of the surface of the integral insulative layer having the crest and root portions.

The application of the above constitution of the invention is not limited to linear portions in a flat cable comprising linear portions and twisted pair portions provided alternately with the linear portions. For example, the constitution of the invention can be applied to various forms of flat cables including those which have, instead of twisted pair portions, roller screen-like portions each composed of insulated conductors merely juxtaposed to one another without adhesion of adjacent insulated conductors, and those free from twisted pair portions or roller screen-like portions.

The resin tape may be applied onto both surfaces or one surface of the integral insulative layer in the juxtaposed insulated conductors. The application of the resin tape onto both surfaces of the integral insulative layer in the juxtaposed insulated conductors may be carried out according to the following two preferred embodimetns. One of them is such that a predetermined part of the insulated conductor located at each end of the juxtaposed plurality of insulated conductors remains exposed without application of the resin tape thereto. The other preferred embodiment is such that the resin tape is extended by a predetermined length from the side of the insulated conductor located at each end of the plurality of insulated conductors juxtaposed to one another and the extended portion of the resin tape applied onto the upper surface of the integral insulative layer in the juxtaposed insulated conductors is adhered to the extended portion of the resin tape applied onto the lower surface of the integral insulative layer in the juxtaposed insulated conductors.

The former embodiment is suitable when the resin tape in its portion extended from each of the outermost located insulated conductors adversely affects the connection of the flat cable to a connector. On the other hand, the latter embodiment is suitable when the flat cable is used in applications where all the insulated conductors should be protected by the resin tape.

In many cases, heat fusion is utilized in adhesion between adjacent insulative layers in the insulated conductors, in the application of the resin tape to the insulative layers, or in adhesion between extended portions in the resin tape.

When the material for the insulative layer is different from the material for the resin tape and it is difficult to fuse the insulative layer to the resin tape, preferably, an adhesive layer having good fusion to the insulative layer is coated on the surface of the resin tape.

Specifically, preferred is a combination of an insulative layer formed of a vinyl chloride polymer, such as polyvinyl chloride, or an ethylene polymer, such as polyethylene, with a polyester tape coated with an adhesive layer of a vinyl chloride polymer or an ethylene polymer.

According to the second feature of the invention, a process for producing a flat cable, comprises the steps of: feeding a plurality of insulated conductors, juxtaposed to one another, together with a resin tape into a mold, the plurality of insulated conductors each comprising a conductor covered with an insulative layer, said mold comprising a combination of openable upper and lower molds, the upper and lower molds each having in its inner surface a plurality of grooves for accommodating therein the plurality of insulated conductors, the mold being constructed so that, upon accommodation of the plurality of insulated conductors respectively in the plurality of grooves in the mold, adjacent insulated conductors come into contact with each other;

after the accommodation of the plurality of insulated conductors and the resin tape in the plurality of grooves of the mold, closing the upper and lower molds to confine the plurality of insulated conductors and the resin tape within the plurality of the grooves; and applying heat to fuse adjacent insulated conductors in their insulative layers to each other to form an integral insulative layer having on its surface crest portions and root portions as viewed in the cross section of the insulated conductors, and to fuse the resin tape to the integral insulative layer so as to conform to the shape of the surface of the integral insulative layer including crest portions and root portions.

The production process of the invention is not limited to flat cables having linear portions and twisted pair portions provided alternately with the linear portions. For example, the production process of the invention can be applied to many forms of flat cables including those which have, instead of twisted pair portions, roller screen-like portions each composed of insulated conductors merely juxtaposed to one another without adhesion of adjacent insulated conductors, and those which are free from twisted pair portions and roller screen-like portions and are entirely constituted by the linear portion.

The resin tape maybe applied onto both surfaces or one surface of the integral insulative layer in the juxtaposed insulated conductors.

In most cases, the material constituting the insulative layers of the insulated conductors used is the same as or similar in molecular structure to the material constituting the resin tape used from the viewpoint of fusion between the insulative layers and the resin tape. In some cases, however, the material constituting the insulative layers of the insulated conductors used is utterly different from the material constituting the resin tape used.

Specifically, for the insulative layer, importance is attached to electric characteristics, while for the resin tape, importance is attached to mechanical properties. An example of a combination, of the insulative layer with the resin tape, capable of providing both good electric characteristics and good mechanical properties is such that the insulative layer is formed of a vinyl chloride polymer, such as polyvinyl chloride, or an ethylene polymer, such as polyethylene, while the resin tape is a polyester tape coated with an adhesive layer of a vinyl chloride polymer or an ethylene polymer.

In this combination, since the polyester tape possesses excellent mechanical properties, a flat cable having a stable structure can be produced.

When the production of a flat cable having linear portions and twisted pair portions is contemplated, the resin tape is fused to the twisted pair portion by means of a heating roller after or before the completion of fusion between the insulative layers of the insulated conductors in the linear portion and fusion between the resin tape and the integral insulative layer formed as a result of the fusion between the insulative layers of the insulated conductors in the linear portion.

According to one embodiment of the invention, in the production of a flat cable, one or a few dummy linear materials may be disposed on both ends of the plurality of insulated conductors juxtaposed to one another.

The linear material may be made of a material not fused to the insulative layers in the insulated conductors and the resin tape. Specific examples thereof include electric wires covered with a fluororesin which is excellent in this property.

The linear material functions to prevent the flow of the resin from the product toward the widthwise direction during the production of the flat cable. In this case, additional grooves for the linear material are provided in the upper and lower molds. After the completion of the flat cable, the linear material is removed from the side of the cable.

BRIEF DESCRIPTION OF THE DRAWING

The invention will be explained in more detail in conjunction with the appended drawings, wherein:

FIGS. 3A and 3B are diagram illustrating a conventional process four producing a flat cable wherein FIG. 3A illustrates the construction of an insulated conductor pair and FIG. 3B illustrates a production line;

FIGS. 8A to 8C are diagrams illustrating the process for producing a flat cable according to a preferred embodiment of the invention wherein FIG. 8A illustrates a production line, FIG. 8B illustrates a cross-sectional view taken on line A—A of FIG. 8A and FIG. 8C illustrates a cross-sectional view taken on line B—B of FIG. 8A.

Like parts have the same reference numerals throughout all of the drawings.

DESCRIPTION OF THE PREFERRED EMBODIMENTS

Before describing flat cables and a process for producing the same according to preferred embodiments of the invention, the conventional flat cables and the process for producing the same will be explained in FIGS. 1, 2, 3, and 7.

Figure 7:
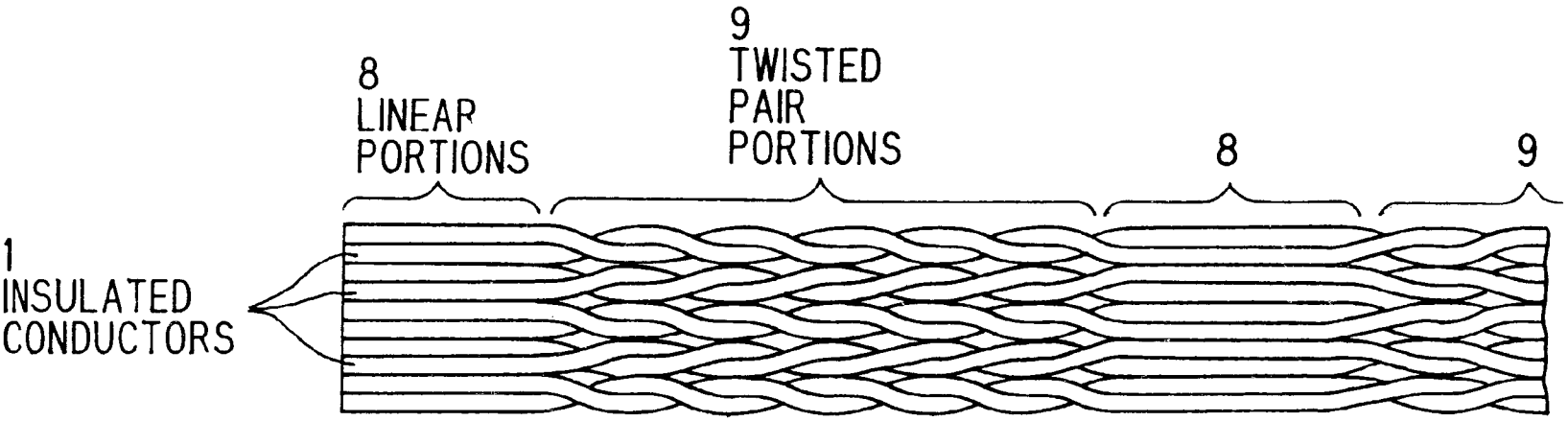
FIG. 7 is a diagram illustrating the construction of a flat cable.

FIG. 7 illustrates general construction of a flat cable. The flat cable comprises: linear portions 8 each comprising a plurality of insulated conductors 1, 1, 1 . . . juxtaposed to one another, the insulated conductors 1 each comprising a conductor covered with an insulative layer; and twisted pair portions 9 provided alternatively with the linear portions 8, the twisted pair portions 9 each comprising a plurality of twisted pairs juxtaposed to each other or one another, the twisted pairs each being composed of two insulated conductors 1,1 which extend from the linear portions and are twisted together.

In flat cables of this type, the construction of the linear portion 8 is an important element. Improper construction of this portion, for example, adversely affects the connection of conductors in the insulated conductors to a connector, making it impossible for the flat cable to have contemplated functions.

Figure 1:
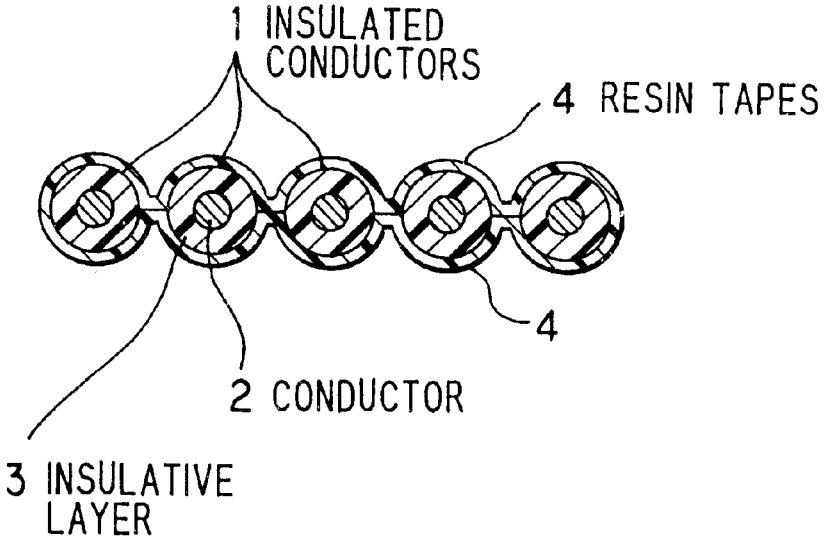
FIG. 1 PRIOR ART
FIG. 1 is a diagram illustrating a conventional flat cable.

FIG. 1 illustrates conventional construction of the linear portion 8. In the linear portion 8, a plurality of insulated conductors 1 each comprising a conductor 2 covered with an insulative layer 3 are provided side by side while leaving a spacing between adjacent insulated conductors 1, and the plurality of insulated conductors 1 are sandwiched between upper and lower resin tapes 4, 4 so that the upper and lower resin tapes 4, 4 are fused to each other in a portion between adjacent insulated conductors 1, 1.

Figure 2:
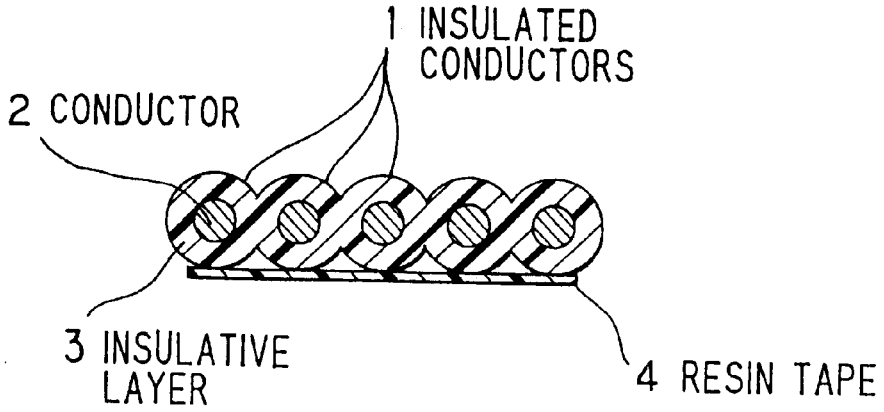
FIG. 2 PRIOR ART
FIG. 2 is a diagram illustrating another conventional flat cable.

FIG. 2 illustrates another conventional construction of the linear portion 8. The linear portion 8 comprises: a plurality of insulated conductors 1 with adjacent insulated conductors 1 in their insulative layers 3 being fused to each other to constitute an integral insulative layer having crest portions and root portions; and a resin tape 4 which is provided on one surface of the integral insulative layer 3 so that it is spottily adhered to the integral insulative layer 3 in its crest portions.

Flat cables having the above constructions, wherein the linear portions 8 have been flattened by the resin tape 4, have been extensively used for internal wiring in electronic equipment, such as personal computers.

The conventional flat cables having the above constructions, however, have the following drawbacks. In the linear portions 8 of the first conventional flat cable shown in FIG. 1, the resin tape 4 is also present in a portion between adjacent insulated conductors 1, 1. This results in increased width dimension of the flat cable. In the case of flat cables, in many cases, the width dimension is regulated. The construction of the first conventional flat cable in its linear portions 8 shown in FIG. 1 makes it difficult to follow the regulation value. Reducing the diameter of the insulated conductors 1 is considered effective for overcoming this difficulty. This, however, leads to deteriorated electric characteristics of the flat cable.

Further, regarding the dimensional accuracy, in the linear portions 8 of the first conventional flat cable shown in FIG. 1, the accuracy of the pitch between insulated conductors 1, 1 is low due to the presence of the resin tape 4 in a portion between adjacent insulated conductors 1, 1. This is likely to cause a failure of fitting at the time of pressure contact connection.

On the other hand, according to the construction of the linear portions 8 in the second conventional flat cable shown in FIG. 2, there is no need to widen the portion between adjacent insulated conductors 1, 1, and the accuracy of pitch between insulated conductors 1, 1 is high. In the linear portions 8 of the second conventional flat cable shown in FIG. 2, however, since the resin tape 4 is spottily adhered to the insulative layer 3, there is a large fear of the resin tape 4 being separated from the insulative layer 3. Further, this construction has an additional problem that, at the time of simultaneous connection of conductors in the insulated conductors of the linear portion to a connector, it is difficult to insert pins of the connector, leading to poor fitting between the cable and the connector.

Figure 3A:
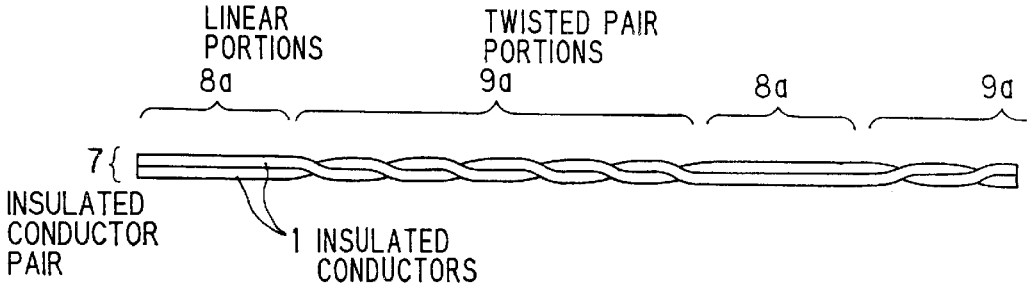
FIG. 3A PRIOR ART
Figure 3B:
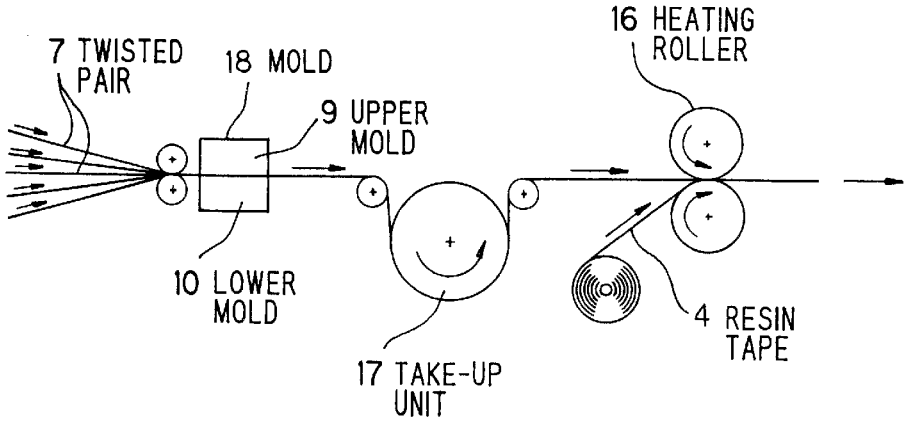
FIG. 3B PRIOR ART

Next, a general conventional production process of flat cables will be explained in FIGS. 3A and 3B. FIGS. 3A illustrates the construction of an insulated conductor pair, and FIG. 3B illustrates a production line. In FIG. 3A, numeral 7 designates an insulated conductor pair. The insulated conductor pair 7 is composed of two insulated conductors 1 each comprising a conductor covered with an insulative layer, and has linear portions 8*a* and twisted pair portions 9*a* provided alternately with the linear portions 8*a* at predetermined spacing. In the linear portions 8*a*, the two insulated conductors 1 are juxtaposed to each other, while in the twisted pair portions 9*a*, the two insulated conductors are twisted together. A predetermined number of insulated conductor pairs 7 are placed side by side and, in this state, are fed from a bobbin (not shown) into a mold 18.

The mold 18 is split into two parts, openable upper mold 9 and lower mold 10. The upper mold 9 and the lower mold 10 have grooves the number of which is such as will be able to receive all the insulated conductors 1 in the linear portions 8*a*.

In the grooves, the insulated conductors 1 are placed in such a positional relationship that adjacent insulated conductors come into contact with each other. In this state, upon application of, heat from the mold 18, the adjacent insulated conductors 1 in their insulative layers are fused to each other to form a belt comprising insulated conductors 1, 1, 1 . . . connected to one another as shown in FIG. 2, thereby providing a linear portion 8, as shown in FIG. 7, wherein the surface of the integrated insulative layer has crest portions and root portions as viewed in the cross section of the linear portion.

The fusion of the insulated conductors 1, 1, 1 . . . to one another is carried out on a batch basis rather than a continuous basis. After the formation of the linear portion 8, the mold 18 is opened. In this state, the twisted portion 9*a* is passed through the mold 18. A next linear portion 8*a* is then fed into the mold 18, and fusion of the insulated conductors 1, 1, 1 . . . to one another is again carried out in the mold 18. The above procedure is then repeated.

After the insulated conductor pairs 7 in their linear portion 8*a* are integrated with one another in the mold 18, they emerge from the mold 18, are passed through a take-up unit 17, and, together with a resin tape 4, are fed into between heating rollers 16 to fuse the resin tape 4 to one surface thereof. Thus, as shown in FIG. 2, a predetermined flat cable is obtained wherein, in the linear portions 8, the resin tape 4 has been spottily adhered onto the integral insulative layer in its crest portions.

The flat cable, of which the flatness of the linear portions 8 is kept by the resin tape 4, enables simultaneous connection of conductors in the linear portion 2 to a connector and hence has been extensively used in various types of electronic equipment including personal computers, and a further increase in demand thereof is expected.

In the conventional production process of a flat cable, as shown in FIG. 2, the adhesion of the resin tape 4 to the integral insulative layer is intermittent. That is, the resin tape 4 is adhered to only the crest portions of the integral insulative layer. This leads to a large fear of the resin tape 4 being separated from the insulative layer 3. This further poses a problem that, at the time of simultaneous connection of conductors in the linear portion to a connector, the resin tape 4 in its portion floating above the root portions of the integral insulative layer inhibits fitting between the linear portion and the connector. The above problems are attributable to fusion using heating rollers 16, and hence are unavoidable without the elimination of reliance of the fusion upon the heating rollers.

Next, preferred embodiments of the flat cable according to the invention will be explained in FIGS. 4 to 6.

Figure 4:
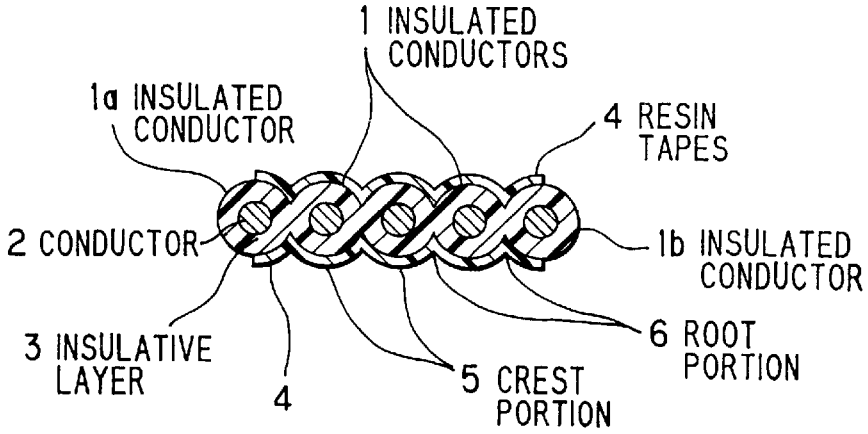
FIG. 4 is a diagram illustrating a flat cable according to the first preferred embodiment of the invention.

FIG. 4 is a cross-sectional view of a flat cable in its linear portion according to the first preferred embodiment of the invention. This flat cable comprises a linear portion in at least a part thereof. The linear portion comprises: a plurality of insulated conductors 1 each comprising a conductor 2 covered with an insulative layer 3 formed of polyvinyl chloride, the plurality of insulated conductors 1 being juxtaposed to one another with a adjacent insulated conductors 1 in their insulative layers 3 being adhered to each other to provide an integral insulative layer having crest portions 5 and root portions 6 as viewed in the cross section of the juxtaposed insulated conductors 1; and a resin tape 4 applied to both surfaces of the integral insulative layer so as to conform to the shape of the surface of the integral insulative layer including the crest portions 5 and root portions 6. In this preferred embodiment, the resin tape 4 is a polyester tape having an adhesive layer (not shown) of polyvinyl chloride coated on one side thereof.

In the application of the resin tape 4 to the integral insulative layer, heat is applied to fuse the resin tape 4 in its adhesive layer to the integral insulative layer so as to conform to the shape of the surface of the integral insulative layer having crest portions 5 and root portions 6. In this case, approximately the half of each of insulated conductors 1*a*, 1*b* located respectively at both ends of the linear portion as viewed in the cross section thereof remains exposed without application of the resin tape 4 thereto. This permits the width dimension of the flat cable to be identical to that of the flat cable not having the resin tape 4.

Figure 5:
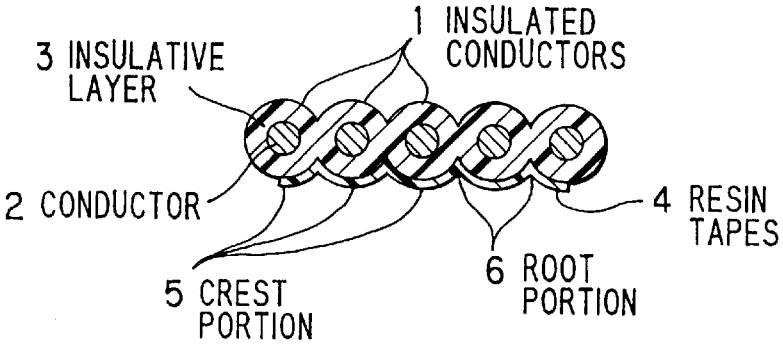
FIG. 5 is a diagram illustrating a flat cable according to the second preferred embodiment of the invention.

FIG. 5 is a cross-sectional view of a flat cable in its linear portion according to the second preferred embodiment of the invention. This preferred embodiment is the same as the first preferred embodiment of the invention shown in FIG. 4, except that the resin tape 4 is applied onto one surface of the integral insulative layer instead of both sides of the integral insulative layer.

Figure 6:
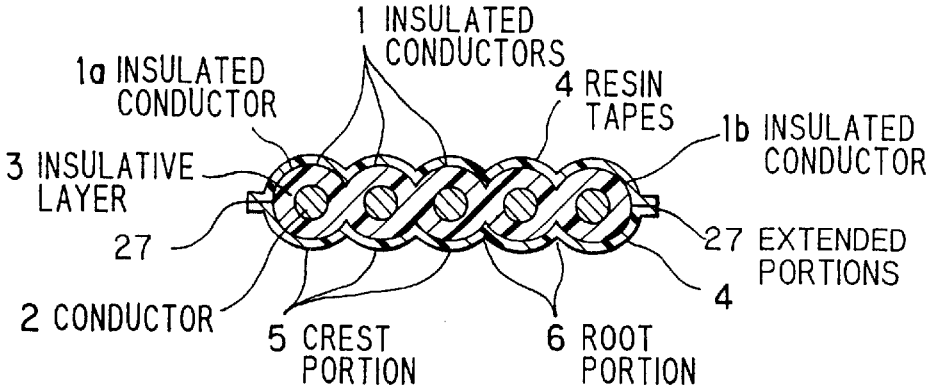
FIG. 6 is a diagram illustrating a flat cable according to the third preferred embodiment of the invention.

FIG. 6 is a cross-sectional view of a flat cable in its linear portion according to the third preferred embodiment of the invention. This preferred embodiment is the same as the first preferred embodiment of the invention shown in FIG. 4, except that the resin tape 4 is extended by a predetermined length from the insulated conductors 1*a*, 1*b* located respectively at both ends of the linear portion as viewed in the cross section thereof. The extended portion 7 of the resin tape 4 applied onto the upper surface of the integral insulative layer is fused to the extended portion 7 of the resin tape applied onto the lower surface of the integral insulative layer. The flat cable according to this preferred embodiment is suitable for applications where all the insulated conductors 1 should be protected by the resin tape 4 against external action.

As described above, according to the flat cable of the invention, in the linear portion comprising a plurality of insulated conductors with adjacent insulated conductors in their insulative layers being adhered to each other to provide an integral insulative layer having crest portions and root portions, a resin tape is applied to the integral insulative layer so as to conform the shape of the surface of the integral insulative layer having crest portions and root portions as viewed in the cross section of the linear portion. By virtue of this constitution, the flat cable of the invention can solve, at a stroke, various problems involved in conventional flat cables, for example, increased width dimension of a flat cable due to a structure with a fused resin tape being present in a portion between adjacent insulated conductors, deteriorated electric characteristics when the diameter of the insulated conductors has been reduced in order to prevent the increase in width dimension, deteriorated electric characteristics attributable to low pitch accuracy among insulated conductors due to a structure with a fused resin tape being present in a portion between adjacent insulated conductors, separation of the resin tape from the insulative layer due to a spot fusion of the resin tape to the insulative layer, and poor fitting between the linear portion and a connector. Therefore, the flat cable of the invention is very useful from the practical point of view.

Next, preferred embodiments of the process for producing a flat cable according to the invention will be explained in FIGS. 8A to 8C.

Production of a flat cable having linear portions 8 and twisted pair portions 9 provided alternately with the linear portions 8 as shown in FIG. 7 will be explained by way of example. Therefore, in this preferred embodiment, insulated conductors disposed side by side correspond to insulated conductors 1 in the insulated conductor pair 7 as shown in FIG. 3A.

Figure 8A:
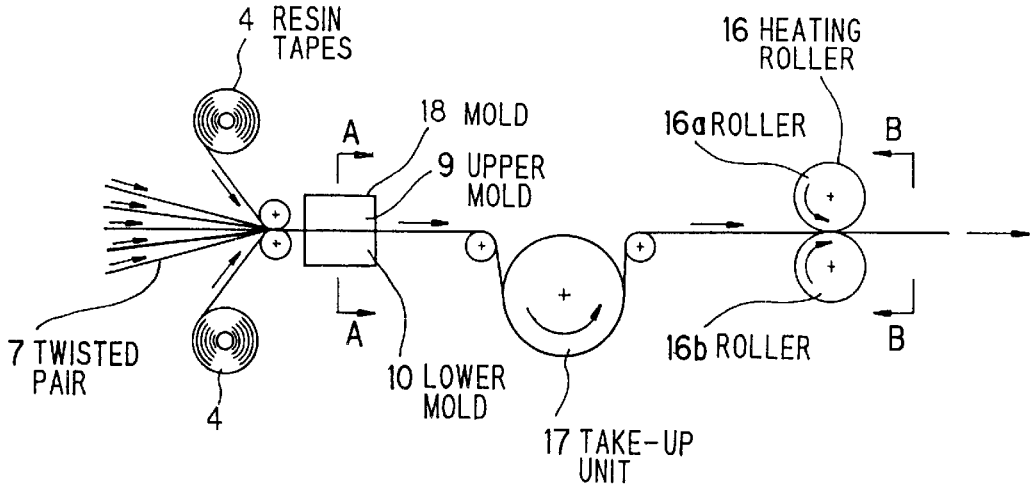

FIG. 8A shows a production line in the preferred embodiment of the process according to the invention. A predetermined number of insulated conductor pairs 7 are first provided. The insulated conductor pair 7 is as explained above in connection with FIG. 3A. The predetermined number of insulated conductor pairs 7 delivered from a bobbin are placed side by side and, together with resin tapes 4, 4, are fed into a mold 18. FIG. 8B is a cross-sectional view taken on line A—A of FIG. 8A. The mold 18 comprises a combination of two parts, mutually openable upper mold 9 and lower mold 10. The upper molds 9 and the lower mold 10 have respective heaters 11, 12. The upper mold 9 and the lower mold 10 each have in its inner surface grooves 13, the number of which is such as will be able to receive all the insulated conductors 1 in the plurality of insulated conductor pairs 7.

The grooves 13 are semi-circular, and constructed in such a dimension that, upon the accommodation of the insulated conductors 1 in the grooves 13, adjacent insulated conductors 1 come into contact with each other.

The insulated conductor pairs 7 and the resin tapes 4, 4 are accommodated in the mold 18 so that upper and lower resin tapes 4, 4 are disposed respectively on the upper and lower parts of the juxtaposed insulated conductor pairs 7 in their linear portion 8*a*.

In this case, the upper mold 9 and the lower mold 10 are opened, the line is moved to feed the linear portion 8*a* having a predetermined length in the insulated conductor pairs 7 together with the resin tapes 4, 4 into the mold 18, and the line is then stopped. In this connection, it should be noted that, when the mold 18 is moved as the insulated conductor pairs 7 move, there is no need to stop the line.

Figure 8B:
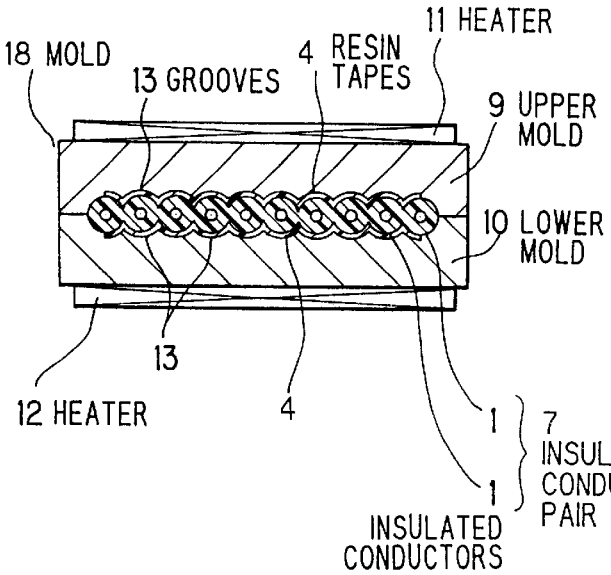
Figure 8C:
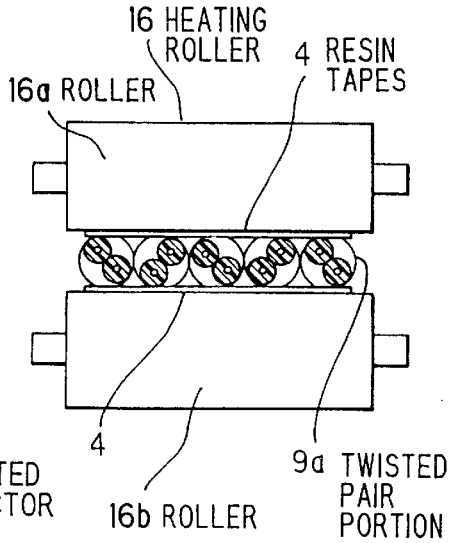

Next, the upper mold 9 and the lower mold 10 are closed, and, as shown in FIG. 8B, the insulated conductors 1 in the insulated conductors pairs 7 and the resin tapes 4, 4 are confined within the grooves 13. In this state, heat from the heaters 11 and 12 is applied to the insulated conductors 1 and the resin tape 4 to fuse the resin tape 4 to the insulated conductors 1.

Upon the completion of heating at a predetermined temperature for a predetermined period of time, the upper mold 9 and the lower mold 10 are opened. In this state, the assembly is allowed to cool for a short period of time, and the line is then moved to feed the next linear portion 8*a* of the insulated conductors pair 7 into the mold 18. The above procedure is then repeated. In this preferred embodiment, fusion of one linear portion 8*a* may be carried out by single heating or by heating a plurality of times.

FIG. 4 is a cross-sectional view of a linear portion of a flat cable produced by the above procedure. As shown in FIG. 4, a plurality of insulated conductors 1,1,1 . . . , juxtaposed to one another, in their insulative layers 3 are fused to each other to provide an integral insulative layer having crest portions and root portions. The resin tape 4 is fused to the upper and lower surfaces of the integral insulative layer so as to conform to the shape of the surface of the integral insulative layer having crest portions and root portions 6.

A particular feature of this flat cable is that, in the linear portions 8, the resin tape 4 is applied so as to conform to the crest portions 5 and the root portions 6 of the integral insulative layer 3. This is advantageous in that there is no fear of the resin tape 4 being separated from the insulative layer 3 and, in addition, a problem of the conventional flat cable, that is, poor fitting in the simultaneous connection of conductors in the linear portion to a connector, can be solved.

After the insulated conductor pairs 1 and the resin tapes 4 are passed through the mold 18, they are passed through a take-up unit 17,and then fed into between rollers 16*a* and 16*b* constituting a heating roller 16 as shown in FIG. 8A. The heating roller 16 serves to fuse the resin tape 4 to the twisted pair portion 9 shown in FIG. 7. As shown in FIG. 8C, a plurality of twisted pair portions 9*a* juxtaposed to each other are sandwiched between the resin tapes 4, and, in this state, heat is applied to fuse the resin tape 4 to the twisted pair portion 9*a*.

Preferably, the fusion of the resin tape 4 to the twisted pair portion 9*a* is carried out so that, in a plurality of insulated conductors 1, 1, 1 . . . constituting twisted pair portions 9*a*, 9*a*, 9*a*, adjacent insulated conductors in their insulative layer 3 are not fused to each other. The rollers 16*a*, 16*b* constituting the heating roller 16 are always driven in a closed state.

As described above, in the process for producing a flat cable according to the invention, a plurality of insulated conductors, juxtaposed to one another, together with a resin tape are fed into a mold. The mold comprises a combination of mutually openable upper and lower molds, the upper and lower molds each having in its inner surface a plurality of grooves for accommodating therein the plurality of insulated conductors. The mold is constructed so that, upon accommodation of the plurality of insulated conductors respectively in the plurality of grooves in the mold, adjacent insulated conductors come into contact with each other. After the accommodation of the plurality of insulated conductors and the resin tape in the plurality of grooves of the mold, the upper and lower molds are closed to confine the plurality of insulated conductors and the resin tape within the plurality of the grooves. Heat is then applied from the mold to the insulated conductors and the resin tape to fuse adjacent insulated conductors in their insulative layers to each other to form an integral insulative layer having on its surface crest portions and root portions as viewed in the cross section of the insulated conductors, and to fuse the resin tape to the integral insulative layer so as to conform to the shape of the surface of the integral insulative layer having crest portions and root portions. By virtue of this constitution, the resin tape can be adhered to a large area of the plurality of insulated conductors. This can prevent the resin tape from being separated from the insulative layer and, in addition, can provide a flat cable wherein the resin tape does not inhibit the connection of conductors in the linear portion to a connector.

The invention has been described in detail with particular reference to preferred embodiments, but it will be understood that variations and modifications can be effected within the scope of the invention as set forth in the appended claims.

What is claimed is:

1. A flat cable comprising: a plurality of insulated conductors each comprising a conductor covered with an insulative layer, said plurality of insulated conductors being juxtaposed to one another with adjacent insulated conductors in their insulative layers being adhered to each other to provide an integral insulative layer having crest portions and root portions as viewed in the cross section of the juxtaposed insulated conductors; and a resin tape applied to the surface of the integral insulative layer so as to conform to the shape of the surface of the integral insulative layer having the crest and root portions, wherein each of the root portion are shaped to have an arcuate and concave profile in accordance with the intersection of round outer peripheries of the insulative layers of the adjacent insulated conductors.

2. The flat cable according to claim 1, wherein the resin tape is applied onto both surfaces of the integral insulative layer in the plurality of juxtaposed insulated conductors.

3. The flat cable according to claim 2, wherein the resin tape is applied onto the integral insulative layer in the plurality of juxtaposed insulated conductors so that a predetermined part of an insulated conductor located at each end of the plurality of juxtaposed insulated conductors remains exposed without application of the resin tape thereto.

4. The flat cable according to claim 2, wherein the resin tape is applied onto the integral insulative layer in the plurality of juxtaposed insulated conductors so that the resin tape extends by a predetermined length from the side of an insulated conductor located at each end of the plurality of juxtaposed insulated conductors to form an extended portion wherein the extended portion of the resin tape applied onto an upper surface of the integral insulative layer in the juxtaposed insulated conductors is adhered to the extended portion of the resin tape applied onto a lower surface of the integral insulative layer in the juxtaposed insulated conductors.

5. The flat cable according to claim 1, wherein the resin tape is applied onto one surface of the integral insulative layer in the plurality of juxtaposed insulated conductors.

6. The flat cable according to claim 1, wherein the insulative layer is formed of a vinyl chloride polymer or an ethylene polymer, the resin tape is a polyester tape coated with an adhesive layer of a vinyl chloride polymer or an ethylene polymer, and the insulative layer is heat fused to the adhesive layer.

7. A process for producing a flat cable, comprising the steps of: feeding a plurality of insulated conductors, juxtaposed to one another, together with a resin tape into a mold, the plurality of insulated conductors each comprising a conductor covered with an insulative layer, said mold comprising a combination of openable upper and lower molds, the upper and lower molds each having in its inner surface a plurality of grooves for accommodating therein the plurality of insulated conductors, the mold being constructed so that, upon accommodation of the plurality of insulated conductors respectively in the plurality of grooves in the mold, adjacent insulated conductors come into contact with each other;

after the accommodation of the plurality of insulated conductors and the resin tape in the plurality of grooves of the mold, closing the upper and lower molds to confine the plurality of insulated conductors and the resin tape within the plurality of the grooves; and applying heat to fuse adjacent insulated conductors in their insulative layers to each other to form an integral insulative layer having on its surface crest portions and root portions as viewed in the cross section of the insulated conductors, and to fuse the resin tape to the integral insulative layer so as to conform to the shape of the surface of the integral insulative layer having crest portions and root portions.

8. The process for producing a flat cable according to claim 7, wherein the plurality of insulated conductors have linear portions and twisted pair portions, the linear portions each comprising the plurality of insulated conductors linearly juxtaposed to one another, the twisted pair portions each comprising a plurality of twisted pairs juxtaposed to each other or one another, the twisted pairs each being composed of two insulated conductors which extend from the linear portion and are twisted together;

in the linear portions, fusing of the plurality of insulated conductors in their adjacent insulative layers to each other and fusing of the resin tape to the surface of the integral insulative layer in the plurality of insulated conductors are carried out in the mold; and in the twisted pair portions, the resin tape is fused to the insulative layers in the plurality of insulated conductors by a heating roller.

* * * * *